US011325752B2

(12) United States Patent
Satonaka

(10) Patent No.: US 11,325,752 B2
(45) Date of Patent: May 10, 2022

(54) BOTTLE CAP AND BOTTLE

(71) Applicant: United Semiconductor Japan Co., Ltd., Kuwana (JP)

(72) Inventor: Takihiko Satonaka, Kuwana (JP)

(73) Assignee: United Semiconductor Japan Co., Ltd., Kuwana (JP)

( * ) Notice: Subject to any disclaimer, the term of this patent is extended or adjusted under 35 U.S.C. 154(b) by 36 days.

(21) Appl. No.: 17/010,818

(22) Filed: Sep. 2, 2020

(65) Prior Publication Data

US 2022/0063873 A1 Mar. 3, 2022

(51) Int. Cl.

| | |
|---|---|
| ***B65D 41/28*** | (2006.01) |
| ***B65D 41/04*** | (2006.01) |
| ***B65D 1/02*** | (2006.01) |

(52) U.S. Cl.

CPC ..... *B65D 41/28* (2013.01); *B65D 1/0246* (2013.01); *B65D 41/04* (2013.01)

(58) Field of Classification Search

CPC ..... B65D 41/0414; B65D 41/0421; B65D 41/0428; B65D 41/045; B65D 41/0478; B65D 41/0471; B65D 41/28

See application file for complete search history.

(56) References Cited

U.S. PATENT DOCUMENTS

| | | | | |
|---|---|---|---|---|
| 3,130,848 A * | 4/1964 | Chancellor | ..... | B65D 41/0414 215/213 |
| 2006/0138073 A1 | 6/2006 | Ooka | | |
| 2014/0116977 A1 * | 5/2014 | Minnette | ..... | B65D 41/045 215/230 |

FOREIGN PATENT DOCUMENTS

| | | |
|---|---|---|
| JP | 55-98759 | 7/1980 |
| JP | 2005-1696 A | 1/2005 |
| JP | 2006-193214 | 7/2006 |
| JP | 2010-83512 | 4/2010 |
| JP | 2014-975 | 1/2014 |
| JP | 2014-213921 | 11/2014 |
| JP | 2019-17342 | 2/2019 |
| JP | 2019-17346 | 2/2019 |
| JP | 2019-77476 | 5/2019 |

OTHER PUBLICATIONS

Kuroki , "Influence of Impurities in Ultra-Pure Water on Ultratrace Analyses with Analytical Instruments", The Japan Society for Analytical Chemistry; Bunseki Kagaku vol. 59,No. 2,pp. 85-93(2010), Apr. 15, 2010.

* cited by examiner

*Primary Examiner* — Andrew T Kirsch
(74) *Attorney, Agent, or Firm* — Winston Hsu

(57) ABSTRACT

A bottle cap is disclosed. The bottle cap includes a cap body having a cover plate and a cylinder part integral with the cover plate. A stopper member protrudes from an inner surface of the cover plate. The stopper member includes a sealing part supported by a support structure integral with the cover plate. An annular guiding plate protrudes from a sidewall surface of the cylinder part and is inclined toward the stopper member to engage with the sealing part.

22 Claims, 9 Drawing Sheets

BOTTLE CAP AND BOTTLE

BACKGROUND OF THE INVENTION

1. Field of the Invention

The present invention relates generally to a device suited for the applications of ultrapure liquid analysis. More particularly, the present invention relates to an improved bottle cap and a bottle or a container cooperating with such bottle cap, which can readily remove air or air bubbles from an inside of the bottle or the container.

2. Description of the Prior Art

Recent enhancements in modern analytical instrumentation have improved the sensitivity of analysis. Trace elements are now measured at ppt or sub-ppt levels. These levels can be achieved if careful control of the analytical protocol is maintained. Contamination can result from anything that comes into contact with the sample, e.g., the laboratory environment, the air, and anything used during sample preparation.

The quality of water has a significant influence on instrumental analyses. Studies concerning ultra-trace analysis represent that blank optimization is only achievable when ultrapure water with sub-ppt level contamination for most of the elements is used. Contamination risks are greatly increased when the ultrapure water is stored. Results clearly indicate that the quality of high purity water degrades with storage time.

Some studies represent that if ultrapure water is left open to the atmosphere, an anion concentration of about 0.1 ppb can be detected within 1 hour, and an anion concentration of about 1 ppb can be detected after 8 hours of storage. Of course, there are differences in the concentration depending on the indoor environment.

Conventionally, after ultrapure water is sampled with a sample container, air bubbles may remain inside the container after closing a lid or a bottle cap. Even if it is thought that the air bubbles have been removed successfully, small amount of air bubbles still may remain on an interior sidewall of the container. It is desirable to use ultrapure water as soon as possible after collection, and not to store it. Where storage is unavoidable, the container preferably may be buried with ultrapure water and sealed in order to eliminate contamination from the atmosphere.

It has been reported that the air sealed within the sample container may be contaminated. Although there are several pollution factors in the trace analysis of ultrapure water, pollution from the environment (atmosphere) is also regarded as a problem. Therefore, there is a strong need in this technical field to provide an improved device for applications of ultrapure liquid analysis to cope with such problem.

SUMMARY OF THE INVENTION

It is one object of the invention to provide an improved device suited for the applications of ultrapure liquid analysis.

It is another object of the invention to provide an improved bottle cap and a bottle or a container cooperating with such bottle cap, which can readily remove or discharge residual air or bubbles from the inside of the bottle or the container.

One aspect of the present invention provides a bottle cap including a cap body comprising a cover plate and a cylinder part integral with the cover plate, and a stopper member protruding from an inner surface of the cover plate. The stopper member includes a sealing part supported by a support structure integral with the cover plate. An annular guiding plate protrudes from a sidewall surface of the cylinder part and is inclined toward the stopper member to engage with the sealing part.

According to some embodiments, the sealing part comprises a convex curved surface.

According to some embodiments, the annular guiding plate defines a central opening to be enclosed by an outer peripheral of the sealing part in a plan view.

According to some embodiments, the sealing part further comprises a central bulge portion, a peripheral bulge portion surrounding the central bulge, and an annular recessed region between the central bulge portion and the peripheral bulge portion.

According to some embodiments, an upper rim of the annular guiding plate is located at the annular recessed region in a plan view.

According to some embodiments, the peripheral bulge portion is located while overlapping an upper portion of the annular guiding plate in a plan view.

According to some embodiments, the support structure comprises a vertical portion integral with the cover plate and a horizontal portion coupled to the vertical portion.

According to some embodiments, the vertical portion comprises a plurality of rods.

According to some embodiments, the support structure further comprises a prop secured to the inner surface of the cover plate and surrounded by the plurality of rods.

According to some embodiments, the horizontal portion is secured to a lower surface of the prop.

According to some embodiments, the sealing part is secured to the horizontal portion and is opposite to the prop.

According to some embodiments, the sealing part and the prop are composed of an elastic material.

According to some embodiments, the annular guiding plate comprises at least one perforation communicating an inner space between the cover plate, the cylinder part, the stopper member, and the annular guiding plate with an outside of the bottle cap.

According to some embodiments, the cylinder part comprises a spiral female threaded portion situated under the annular guiding plate.

According to some embodiments, the bottle cap further comprises an elastic sealing film adhered to a lower surface of the annular guiding plate.

According to some embodiments, the bottle cap further comprises an annular fixing structure integral with the cap body and in proximity to the cylinder part.

According to some embodiments, the inner space is divided into a first space and a second space by the annular fixing structure, and wherein the annular fixing structure comprises at least one channel that communicates the first space with the second space.

Another aspect of the invention provides a bottle that cooperates with the above-described bottle cap.

According to some embodiments, the bottle comprises a bottle neck for the bottle cap to screw thereto.

According to some embodiments, the bottle neck comprises a spiral male threaded portion, and wherein the spiral male threaded portion is not continuous and comprises a slit in a vertical direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
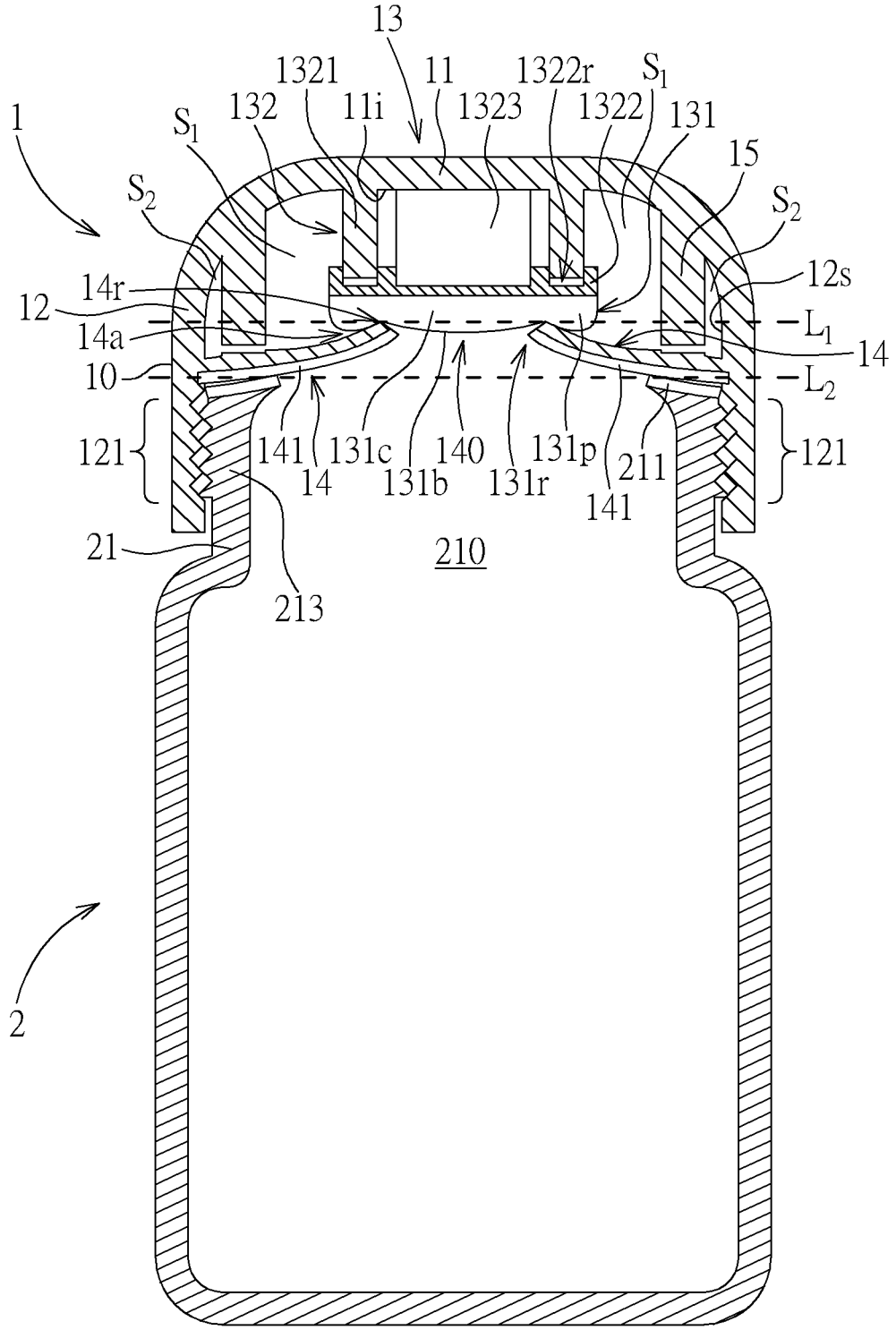
FIG. 1 is a schematic, cross-sectional diagram illustrating an improved bottle cap adapted to cooperate with a bottle neck of a bottle according to one embodiment of the invention.

In the following detailed description of the disclosure, reference is made to the accompanying drawings, which form a part hereof, and in which is shown, by way of illustration, specific embodiments in which the invention may be practiced. These embodiments are described in sufficient detail to enable those skilled in the art to practice the invention.

Other embodiments may be utilized and structural, logical, and electrical changes may be made without departing from the scope of the present invention. Therefore, the following detailed description is not to be considered as limiting, but the embodiments included herein are defined by the scope of the accompanying claims.

The semiconductor industry is advancing rapidly with an increased demand for more chips per wafer and narrower linewidths in the single digit nanometer range. In order to meet these challenges, monitoring and control of ultrapure liquid such as ultrapure water (UPW) preferably may be implemented to detect ionic impurities among other things that could negatively impact wafer yield. Ensuring that contaminant levels of ultrapure water used in semiconductor fabrication processes remain as low as possible is an important challenge.

Due to newly developed instrumentation, limits of detection reached by trace analysis are becoming lower and lower. Ultrapure water or highly purified water (HPW) is water that has been purified to uncommonly stringent specifications. Ultrapure water is a commonly used term in the semiconductor industry to emphasize the fact that the water is treated to the highest levels of purity for all contaminant types, including: organic and inorganic compounds; dissolved and particulate matter; volatile and non-volatile, reactive and inert; hydrophilic and hydrophobic; and dissolved gases.

For ultrapure water analysis, it is desirable to use ultrapure water as soon as possible after collection, and not to store it. Where storage is unavoidable, the sample container preferably may be buried with ultrapure water and sealed in order to eliminate contamination from the atmosphere. Since the air sealed within the sample container may be contaminated, it is desirable to remove the residual air or bubbles remained inside the sample container before the collected ultrapure water is stored or used. However, even if it is thought that the air or bubbles have been removed successfully, small amount of air or bubbles still may remain on the interior sidewall of the sample container. The conventional sample container is not able to readily remove the air or bubbles from inside the sample container after collection of the ultrapure water. The present invention addresses this issue.

The present invention pertains to a screw cap for closing a bottle or a container, which can readily remove or discharge residual air or bubbles from the inside of the bottle or the container. The improved screw cap has low profile, is cost-effective and easy to operate. The invention can be applied in the technical fields including, but not limited to, semiconductor manufacturing, water treatment, medical treatment, research and development, biotechnology, thermal power generation, nuclear power generation, or the like. The screw cap has a structure for removing bubbles inside the bottle without impairing the functionality of the sample container, and anyone can easily remove the bubbles remaining inside the container by operating the novel screw cap.

FIG. 1 is a schematic, cross-sectional diagram illustrating an improved bottle cap adapted to cooperate with a bottle neck of a bottle according to one embodiment of the invention. As illustrated in FIG. 1, according to one embodiment, the bottle 2 comprises a bottle neck 21 for the bottle cap 1 to screw thereto. According to one embodiment, the bottle cap 1 comprises a cap body 10 having a cover plate 11 and a cylinder part 12. The cylinder part 12 is formed integrally with the cover plate 11 so as to form a cap enclosure. According to one embodiment, the cover plate 11 may have a circular shape, and the cylinder part 12 may have an inner area with thread to be mounted on the cylindrical bottle neck 21 of the bottle 2 or a container with thread. According to one embodiment, the bottle cap 1 is screwed onto the bottle neck 21 of the bottle 2 to seal the mouth 210 of the bottle 2.

According to one embodiment, the cap body 10 may be made of high-density polyethylene or fluorine resins, but not limited thereto. According to one embodiment, the bottle 2 may be made of high-density polyethylene or fluorine resins, but not limited thereto. According to one embodiment, the cap body 10 and the bottle 2 may be made of the same material. According to one embodiment, the cap body 10 may be made of a material that is different from that of the bottle 2.

According to one embodiment, the bottle cap 1 further comprises a stopper member 13, which axially protrudes from an inner surface 11*i* of the cover plate 11 of the bottle cap 1 toward the mouth 210 of the bottle 2. According to one embodiment, the stopper member 13 comprises a sealing part 131, which may be mechanically supported by a support structure 132. According to one embodiment, the support structure 132 may be formed integrally with the cover plate 11.

According to one embodiment, the bottle cap 1 further comprises an annular guiding plate 14 that laterally protrudes inwardly from a sidewall surface 12*s* of the cylinder part 12. According to one embodiment, the annular guiding plate 14 is inclined toward the stopper member 13 to engage with the sealing part 131. When the bottle cap 1 is mounted on the bottle neck 21 of the bottle 2, the annular guiding plate 14 merely masks an annular, peripheral region of the mouth 210 of the bottle 2. According to one embodiment, the annular guiding plate 14 defines a central opening 140 to be sealed by the sealing part 131.

According to one embodiment, the sealing part 131 comprises a bottom surface 131*b* that can seal the central opening 140 defined by the annular guiding plate 14. According to one embodiment, the bottom surface 131*b* is a convex, curved surface, which facilitates the removal of air or bubbles after collection of pure liquid. According to one embodiment, the sealing part 131 further comprises a central bulge portion 131*c*, a peripheral bulge portion 131*p* surrounding the central bulge portion 131*c*, and an annular recessed region 131*r* between the central bulge portion 131*c* and the peripheral bulge portion 131*p*. The peripheral bulge portion 131*p* is formed integrally with the central bulge portion 131*c* and the central bulge portion 131*c* defines the bottom surface 131*b*.

According to some embodiments, an upper rim 14*r* of the annular guiding plate 14 rests against the annular recessed region 131*r*. In other words, the upper rim 14*r* of the annular guiding plate 14 is located at the annular recessed region 131*r* in a plan view where the bottle cap 1 is not screwed. And the bottle cap 1 may have a space between the upper rim 14*r* of the annular guiding plate 14 and the annular recessed region 131*r*, where the bottle cap 1 is not screwed. According to some embodiments, the peripheral bulge portion 131*p* leans against an upper portion 14*a* of the annular guiding plate 14. In other words, the peripheral bulge portion 131*p* is located while overlapping the upper portion 14*a* of the annular guiding plate 14 in a plan view, where the bottle cap is not screwed. And the bottle cap 1 may have a space between the peripheral bulge portion 131*p* and the upper portion 14*a* of the annular guiding plate 14, where the bottle cap 1 is not screwed.

According to one embodiment, the support structure 132 comprises a vertical portion 1321 that is formed integrally with the cover plate 11, and a horizontal portion 1322 coupled to the vertical portion 1321. According to one embodiment, the support structure 132 further comprises a resilient prop 1323 secured to the inner surface 11*i* of the cover plate 11. According to one embodiment, the horizontal portion 1322 is secured to a lower surface of the prop 1323. According to one embodiment, the sealing part 131 is secured to the horizontal portion 1322 and is opposite to the prop 1323.

According to one embodiment, the sealing part 131 and the prop 1323 may be composed of an elastic material including, but not limited to, low-density polyethylene. According to one embodiment, the vertical portion 1321 and the horizontal portion 1322 are composed of a material same as the cap body 10. For example, the vertical portion 1321 and the horizontal portion 1322 of the support structure 132 may be made of high-density polyethylene or fluorine resins, but not limited thereto.

Figure 2:
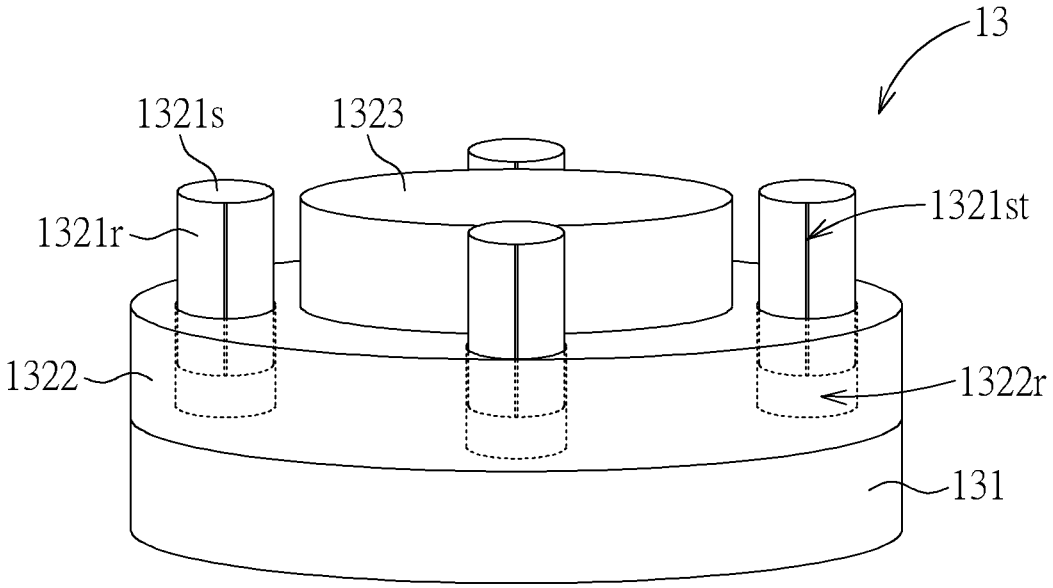
FIG. 2 is a perspective view of the stopper member in a normal position according to one embodiment of the invention.
Figure 3:
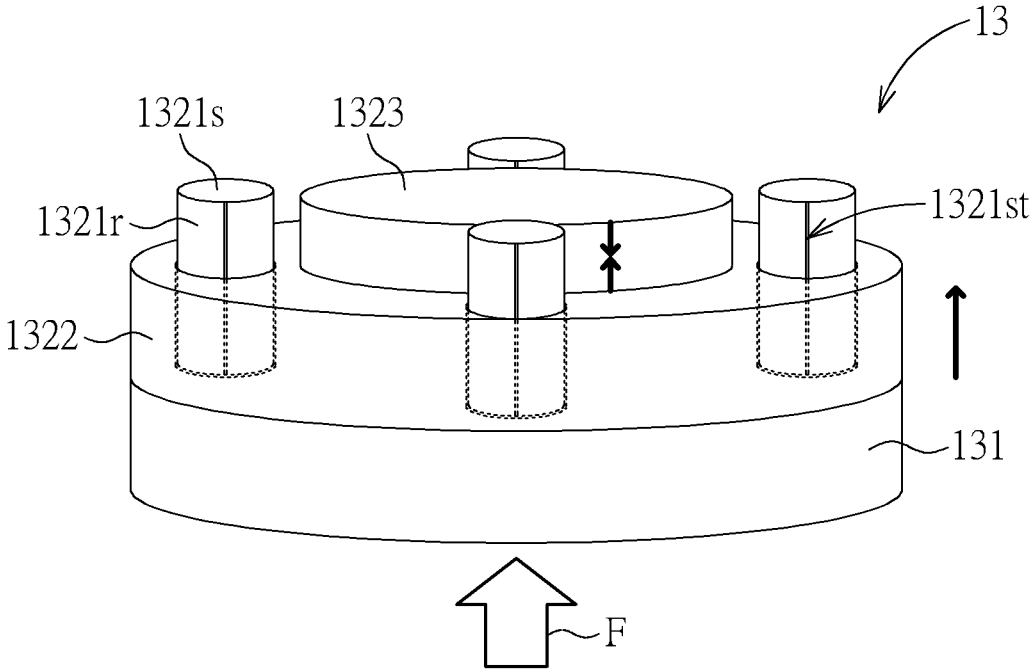
FIG. 3 is a perspective view of the stopper member in a compressed position during operation of expelling air or bubbles according to one embodiment of the invention.

Please also refer to FIG. 2 and FIG. 3. FIG. 2 is a perspective view of the stopper member 13 in a normal position according to one embodiment of the invention. For the sake of clarity, the cap body 10 is not represented in this figure according to one embodiment of the invention. FIG. 3 is a perspective view of the stopper member 13 in a compressed position during operation of expelling air or bubbles according to one embodiment of the invention.

As illustrated in FIG. 2, according to one embodiment, the vertical portion 1321 may comprise a plurality of rods 1321*r*. For example, four rods 1321*r* are represented in this figure. For example, each of the four rods 1321*r* may have a cylinder shape, but not limited thereto. An end surface 1321*s* of each of the plurality of rods 1321*r* is connected and fixed to the cover plate 11, which is not represented in this figure.

According to one embodiment, the prop 1323 is secured to the inner surface 11*i* of the cover plate 11 and surrounded by the plurality of rods 1321*r*. According to some embodiments, the horizontal portion 1322 comprises at least one recess on its upper surface for engaging with the vertical portion 1321. For example, as illustrated in FIG. 2, the horizontal portion 1322 comprises four recessed structures 1322*r*, which receive the lower ends of the four rods 1321*r* respectively, to buffer the vertical movement of the vertical portion 1321 during operation. During operation, as illustrated in FIG. 2 and FIG. 3, the four rods 1321*r* may guide the horizontal portion 1322 to move in a vertical direction, like pistons in an engine. By providing such configuration, an air tightness of the bottle 2 when mounted with the bottle cap 1 can be improved.

Optionally, each of the four rods 1321*r* may comprise a trench or a slot 1321*st* provided on the surface and along a lengthwise direction of each of the four rods 1321*r*. As can be seen in FIG. 3, when the prop 1323 is slightly compressed due to the stress F from the upper rim 14*r* of the annular guiding plate 14 (illustrated in FIG. 1), the lower ends of the four rods 1321*r* are received by the four recessed structures 1322*r* and the lower ends of the four rods 1321*r* may reach to the bottom surfaces of the four recessed structures 1322*r*, thereby engaging with the horizontal portion 1322. In this case, the slot 1321*st* facilitates to exhaust the air in the recessed structures 1321*r* during operation. The stopper member 13 will not exert excessive pressure on the annular guiding plate 14 to prevent its deformation and improve its durability.

Referring back to FIG. 1, according to some embodiments, the bottle cap 1 may further comprise an elastic sealing film 141 adhered to a lower surface of the annular guiding plate 14. According to one embodiment, a gasket or an elastic sealing film 211 is attached to an upper end surface of the bottle neck 21. The elastic sealing film 141 and the elastic sealing film 211 together seal the space between two mating surfaces between the bottle cap 1 and the bottle neck 21, thereby preventing leakage from or into the bottle 2 while under compression. The elastic sealing film 141 may be used alone, without the elastic sealing film 211, though both of the elastic sealing film 141 and the elastic sealing film 211 are represented in FIG. 1.

According to one embodiment, the bottle cap 1 may further comprise an annular fixing structure 15 that is formed integrally with the cap body 10. According to one embodiment, the annular fixing structure 15 may be disposed in proximity to the cylinder part 12.

Figure 4:
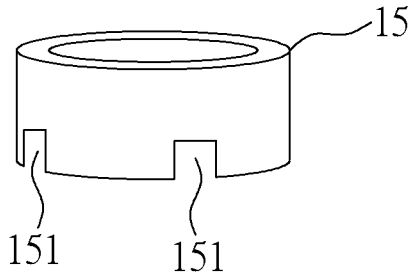
FIG. 4 is a perspective view illustrating only the annular fixing structure according to one embodiment of the invention.
Figure 5:
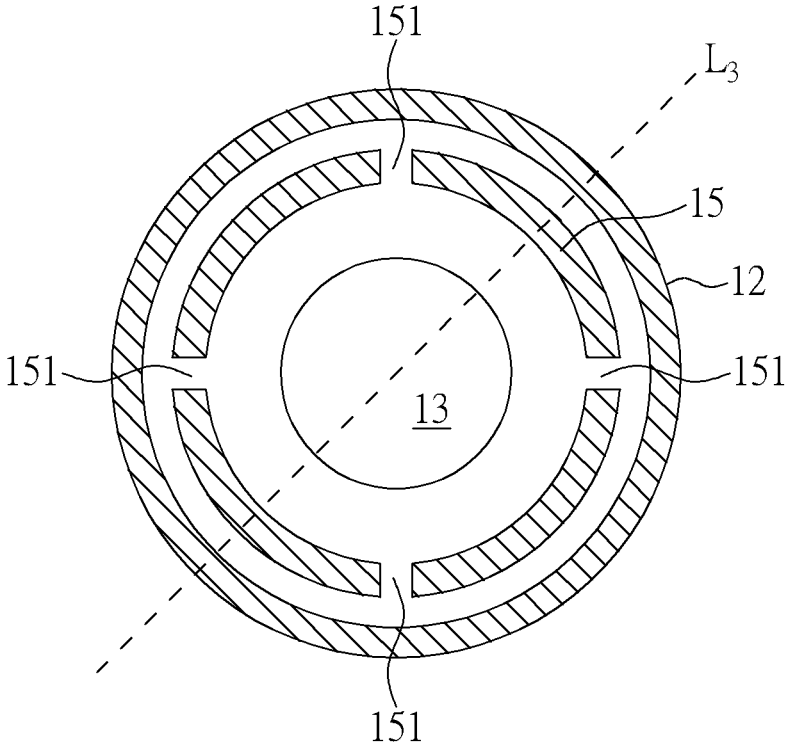
FIG. 5 is a plan view of the bottle cap with the annular fixing structure according to one embodiment of the invention.

Please also refer to FIG. 4 and FIG. 5. FIG. 4 is a perspective view illustrating only the annular fixing structure 15 according to one embodiment of the invention. FIG. 5 is a plan view of the bottle cap 1 with the annular fixing structure 15 taken along the horizontal plane $L_1$ in FIG. 1. It is to be understood that the cross view of the bottle cap 1 in FIG. 1 is taken along the sectional line $L_3$ in FIG. 5. For the sake of clarity, FIG. 4 merely represents the annular fixing structure 15, and the cap body 10 and the stopper member 13 are not represented. As illustrated in FIG. 4 and FIG. 5, and briefly to FIG. 1, the annular fixing structure 15 surrounds the stopper member 13 and is disposed in a position that is approximately aligned with the underlying upper end surface of the bottle neck 21 when the bottle cap 1 is screwed onto the bottle neck 21.

When the bottle cap 1 is screwed onto the bottle neck 21, the annular fixing structure 15 presses the annular guiding plate 14 to force the elastic sealing film 141 and the elastic sealing film 211 to close together such that the space between the annular guiding plate 14 and the upper end surface of the bottle neck 21 is sealed, which avoids leakage of the collected liquid from the inside of the bottle 2. The elastic sealing film 141 may only be used without the elastic sealing film 211, if leakage can be avoided effectively, for example.

In addition, the annular fixing structure 15 may comprise at least one channel 151 that facilitates the removal of the residual air from the inside of the bottle 2. For example, four channels 151 positioned at the bottom of the annular fixing structure 15 are illustrated in FIG. 5. As can be best seen in FIG. 1, when the bottle cap 1 is screwed onto the bottle neck 21, the inner space between the cover plate 11, the cylinder part 12, the stopper member 13, and the annular guiding plate 14 of the bottle cap 1 may be divided into a first space $S_1$ and a second space $S_2$ by the annular fixing structure 15. The at least one channel 151 communicates the first space $S_1$ with the second space $S_2$. For example, number of the channel 151 may be two, three, four or more than four, if a strength of the annular fixing structure may be improved.

Figure 6:
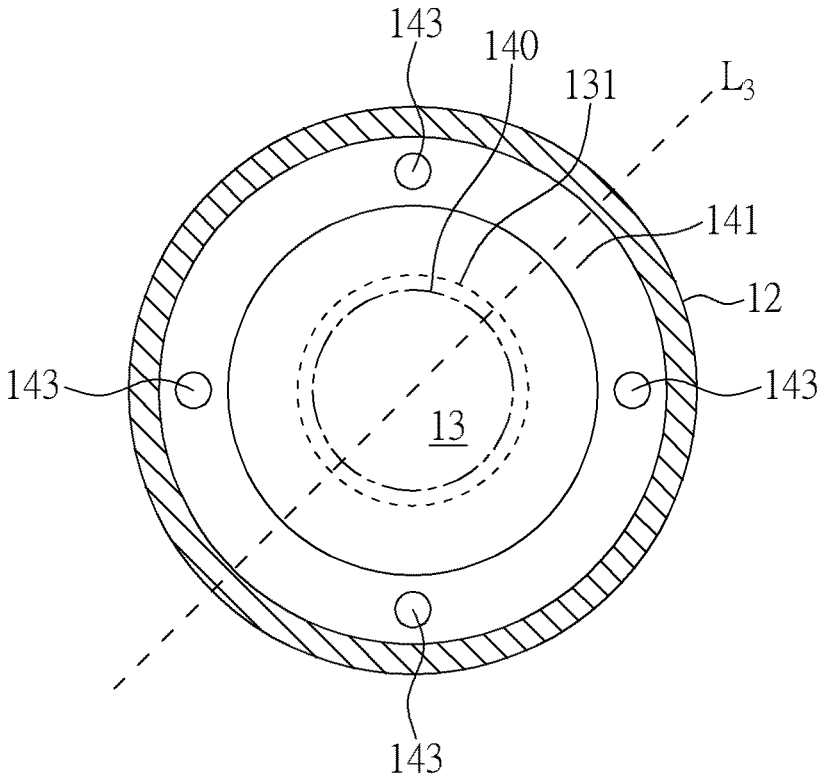
FIG. 6 is a plan view of the bottle cap illustrating the perforation of the annular guiding plate according to one embodiment of the invention.

FIG. 6 is a plan view of the bottle cap 1 taken along the horizontal plane $L_2$ in FIG. 1. For the sake of understanding, FIG. 6 merely represents the sealing part 131 of the stopper member 13 and the central opening 140 of the annular guiding plate 14 with dashed lines, which originally are not represented taken along the horizontal plane $L_2$ so that the sealing part 131 and the central opening 140 are located at backside of $L_2$ in a view from a bottom of the bottle 2 in illustrated FIG. 1. The central opening 140 of the annular guiding plate 14 is enclosed by an outer peripheral of the sealing part 131 in a plan view. As illustrated in FIG. 6, according to one embodiment, the annular guiding plate 14 and the elastic sealing film 141 may comprise at least one perforation 143 for exhausting air and/or liquid from the inner space between the cover plate 11, the cylinder part 12, the stopper member 13, and the annular guiding plate 14. For example, number of the perforation 143 may be two, three, four or more than four, if a strength of the annular guiding plate 14 may be improved. In other words, the at least one perforation 143 can communicate the inner space between the cover 11, the cylinder part 12, the stopper member 13, and the annular guiding plate 14 with an outside of the bottle cap 1. For example, as illustrated in FIG. 6, four perforations 143 are represented. According to one embodiment, preferably, the four perforations 143 correspond to the four channels 151 of the annular fixing structure 15. According to one embodiment, preferably, the four perforations 143 are disposed in close proximity to the cylinder part 12 and are aligned with the four channels 151 in a radial direction, respectively.

Figure 7:
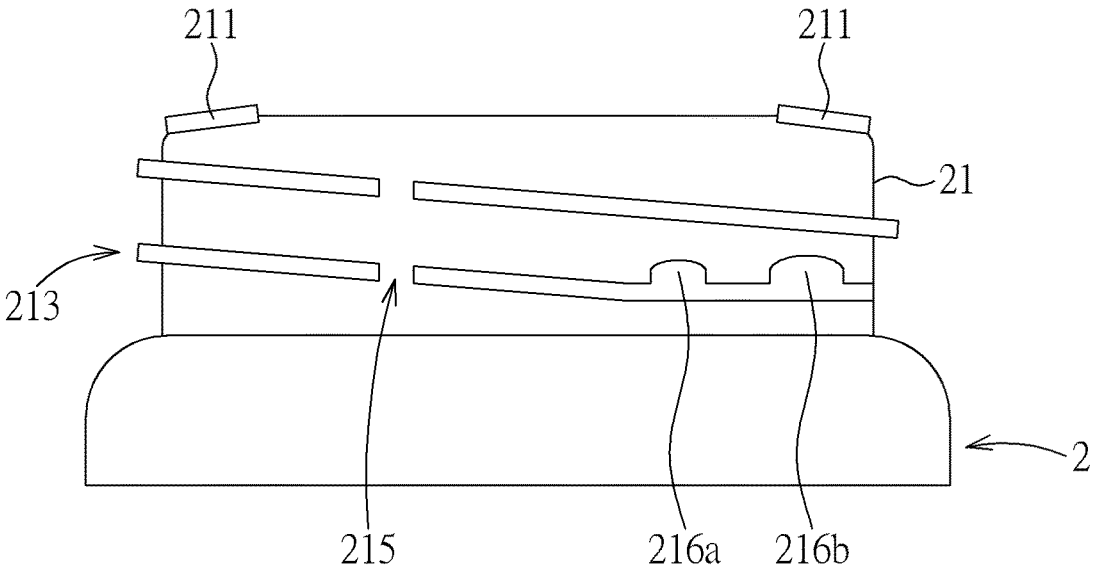
FIG. 7 is a side view illustrating the threaded the bottle neck of the bottle according to one embodiment of the invention.

Please refer to FIG. 7, and briefly to FIG. 1. FIG. 7 is a side view illustrating the threaded bottle neck of the bottle according to one embodiment of the invention. As illustrated in FIG. 1 and FIG. 7, according to one embodiment, the cylinder part 12 of the bottle cap 1 comprises a spiral female threaded portion 121 situated under the annular guiding plate 14, which cooperates with a complementary spiral male threaded portion 213 of the bottle neck 21 of the bottle 2. As illustrated in FIG. 7, the bottle neck 21 comprises the spiral male threaded portion 213. The spiral male threaded portion 213 is not continuous and comprises a slit 215 in a vertical direction for exhausting air and/or liquid from inside the bottle cap 1. The slit 215 of the spiral male threaded portion 213 is to make the liquid and air inside the bottle cap 1 easily discharged to an outside.

According to one embodiment, the spiral male threaded portion 213 comprises at least one protrusion near its lower extremity to prevent the bottle cap 1 from not being closed properly or being closed too tightly due to individual differences of users. For example, a smaller protrusion 216*a* and a larger protrusion 216*b* may be provided near the lower extremity of the spiral male threaded portion 216.

Figure 8:
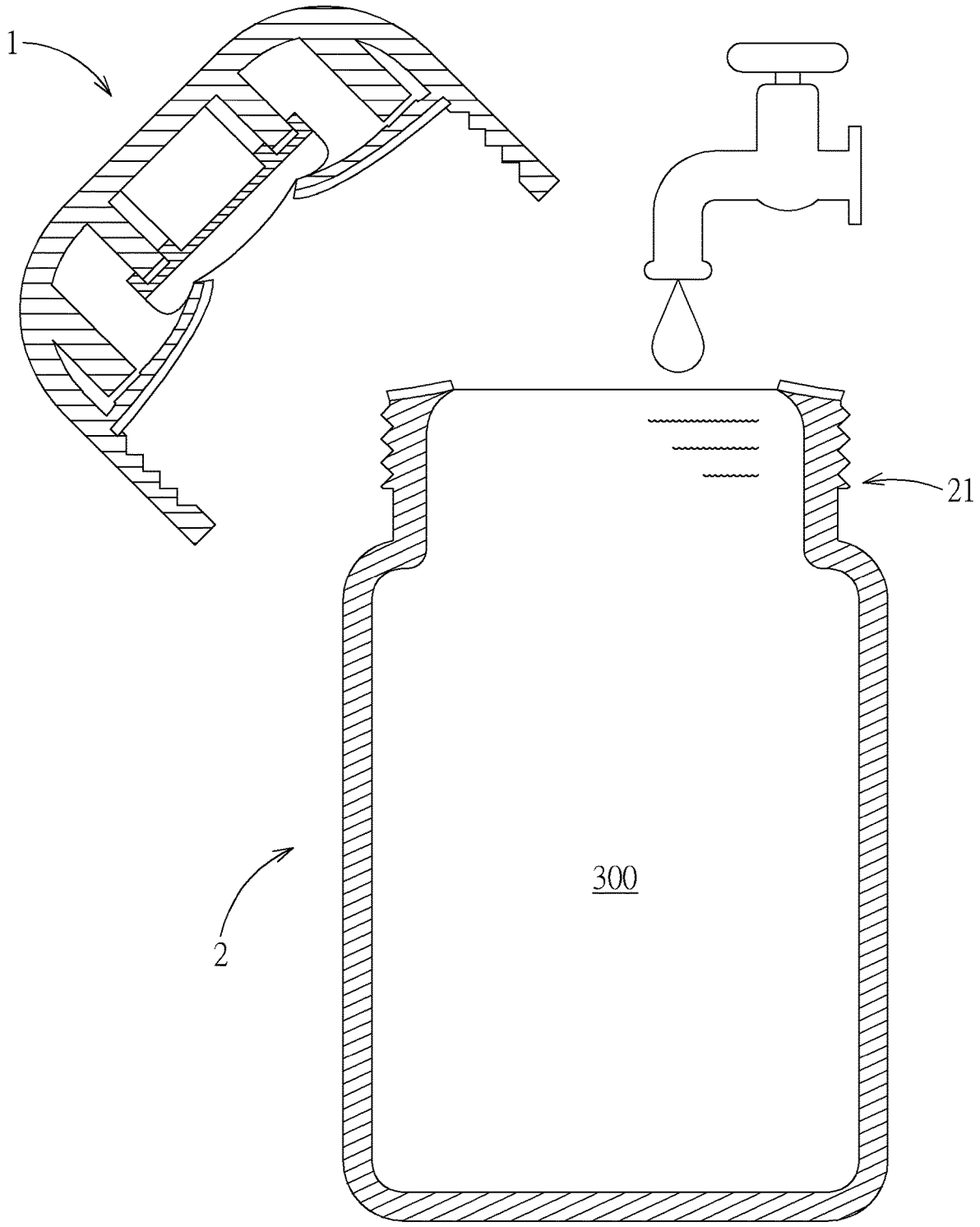
FIG. 8 to FIG. 11 illustrate the operation of discharging the bubble from the inside of the bottle with the improved bottle cap according to one embodiment of the invention.
Figure 9:
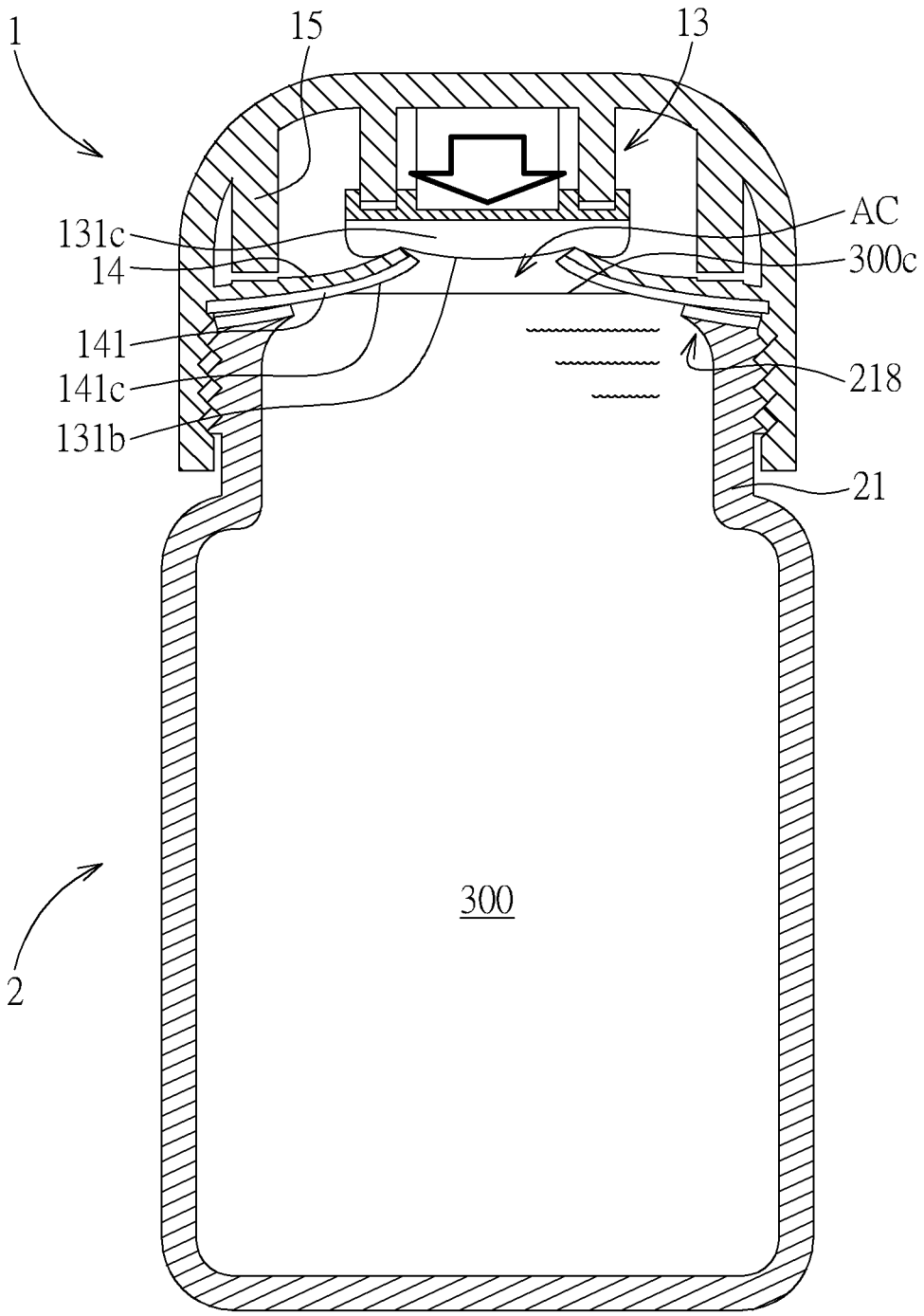

Please refer to FIG. 8 to FIG. 11. FIG. 8 to FIG. 11 illustrate the operation of discharging the bubble from the inside of the bottle with the improved bottle cap according to one embodiment of the invention, wherein like elements, layers or regions are designated by like numeral numbers. As illustrated in FIG. 8, the bottle 2 is filled with liquid 300 such as ultrapure water. As illustrated in FIG. 9, the bottle cap 1 is then gently screwed onto the bottle neck 21 of the bottle 2. At this point, the bottle cap 1 is not tightly closed and air remaining inside the bottle 2 may be gathered to a small central region AC between the top surface 300*c* of the liquid 300, the slightly upwardly inclined surface 141*c* of the elastic sealing film 141 that is adhered to a lower surface of the annular guiding plate 14, and the curved bottom surface 131*b* of the central bulge portion 131*c*.

According to one embodiment, the curved chamfer 218 provided around the upper end surface of the bottle neck 21 makes it easier to gather the bubbles in the central region AC. Further, by rounding (curving) the upper corner of the container mouth, it is possible to prevent air from staying and facilitate the outflow to the outside. According to one embodiment, the central region AC is designed to be as small as possible.

Figure 10:
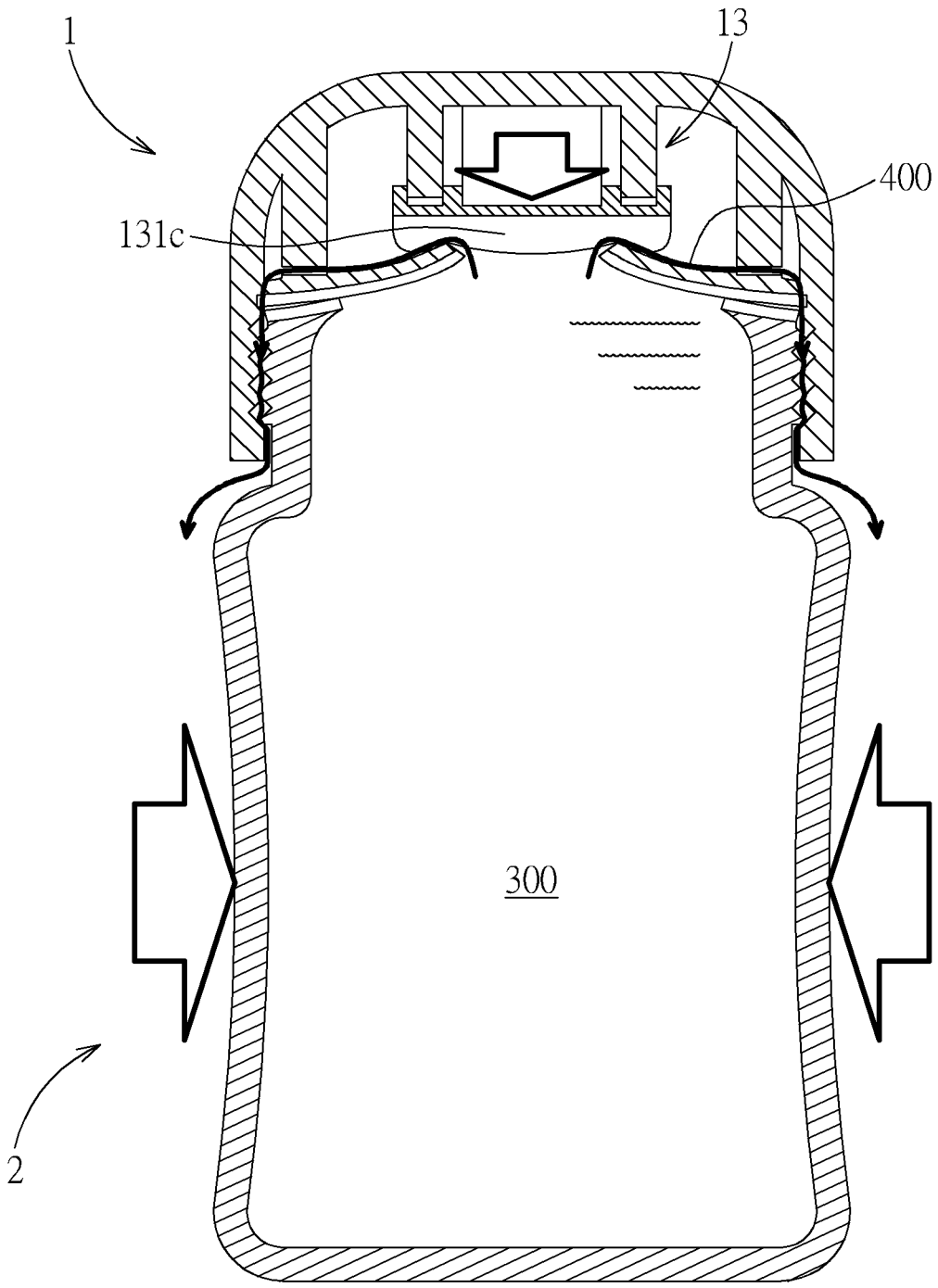
Figure 11:
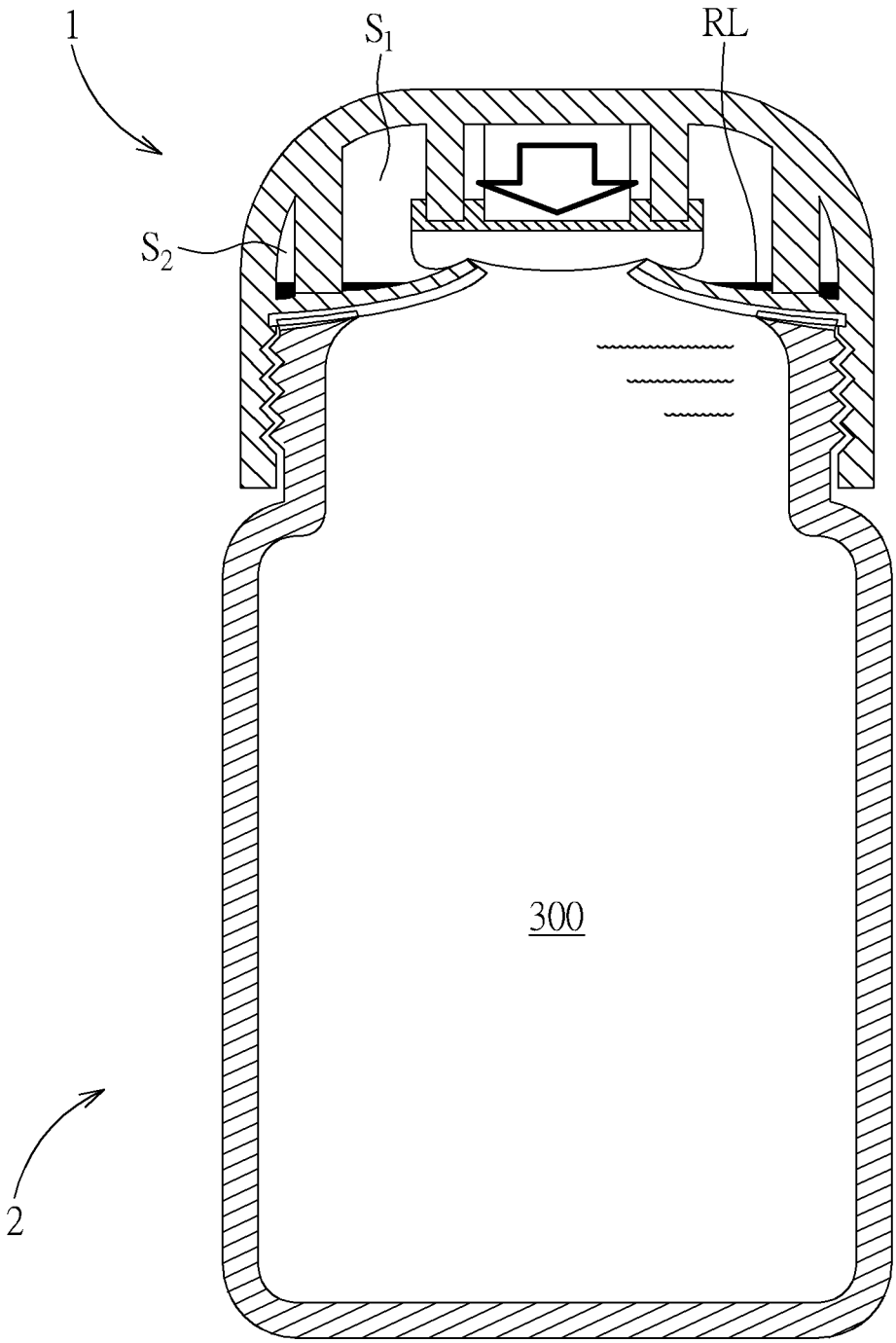

As illustrated in FIG. 10, one can hold the bottle 2 and exert pressure on the bottle 2 to discharge the residual air and liquid from inside the bottle 2 via the path as indicated by the arrows 400. Since central bulge portion 131*c* of the stopper member 13 has a curved bottom surface 131*b*, the bubbles can escape from the inside of the bottle 2 easily. After discharging the air, the airtightness inside the bottle 2 increases. As illustrated in FIG. 11, after the air and liquid are discharged to the outside, the bottle cap 1 is tightly closed to the firmly locked position to tightly close the mouth of the bottle 2. The mouth of the bottle 2 is then sealed by the bottle cap 1. At the same time, a bottom of the vertical portion 1321 may be in direct contact with an upper surface of the recess 1322*r* of horizontal portion 1322. Moreover, a bottom of the annular fixing structure 15 may be in direct contact with an upper surface of the annular guiding plate 14. In contacting of one or both as described above, an excessive force for the resilient prop 1323 effectively can be reduced. Hereinto, as illustrated in FIG. 11, a residual liquid RL may remain within the first space S1 and the second space S2, which is not an ideal case. Even if the residual liquid RL in an inner space of the bottle cap 1 where the bottle cap 1 is screwed, the residual liquid RL can be flowed along the annular guiding plate 14, the perforation 143, and an inner surface of the cylinder part 12 toward the outside of the bottle cap 1 where the bottle cap 1 is screwed to open the bottle 2, again. Therefore, even if the residual liquid RL is polluted by a remained air, gas or etc., a mixing of the residual liquid RL and the liquid 300 such as the ultrapure water can be prevented.

Figure 12:
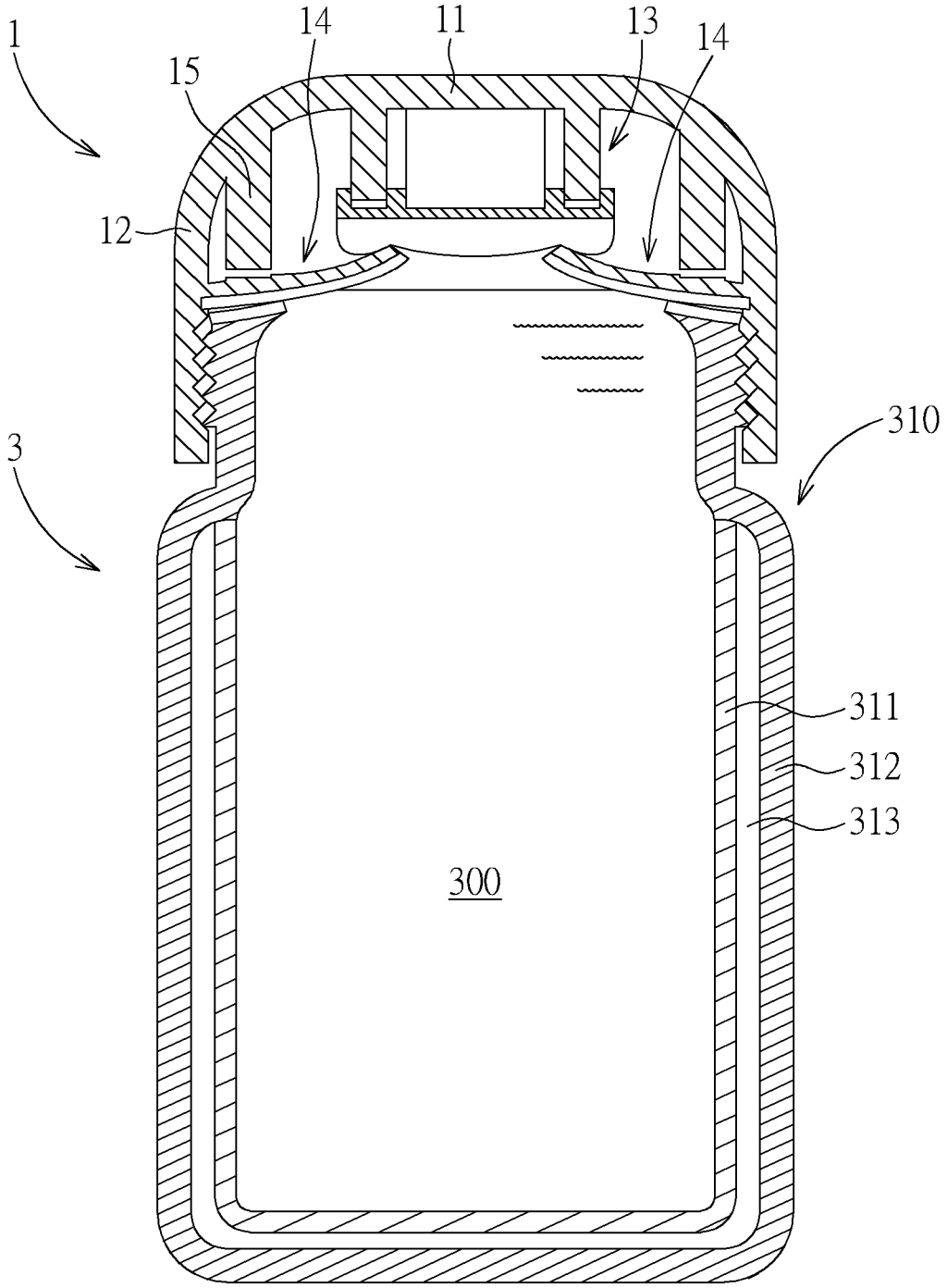
FIG. 12 is a schematic diagram illustrating a dual-layer bottle with the bottle cap according to another embodiment of the invention.

FIG. 12 is a schematic diagram illustrating a dual-layer bottle with the bottle cap according to another embodiment of the invention. As illustrated in FIG. 12, according to one embodiment, the bottle 3 comprises a dual-layer wall structure 310 comprising an inner wall 311 and an outer wall 312. An air gap 313 is provided between the inner wall 311 and the outer wall 312. By providing the bottle 3 with such dual-layer wall structure 310, airtightness can be improved while absorbing a force due to an expansion or a contraction of the liquid 300. Preferably, an elasticity of the inner wall 311 may be lower than an elasticity of the outer wall 312 to absorb the force.

It is advantageous to use the present invention because the bottle cap or screw cap has a structure for removing or discharging bubbles or residual air inside the sample bottle without impairing the functionality of the sample bottle, and anyone can easily remove the bubbles remained inside the sample bottle by operating the novel bottle cap or screw cap. By simply exerting suitable pressure on the bottle, the air bubbles can escape from the inside of the sample bottle. Additionally, the elasticity of the inner wall 311, which is lower than the outer wall 312, can reduce unnecessary force inside of the bottle 3 and relax the unnecessary force of several parts of the bottle cap 1. For instance, the several parts are the sealing part 131, the vertical portion 1321, the horizontal portion 1322, the resilient prop 1323 and the annular guiding plate 14, etc.

To sum up, the improved bottle cap has an improved structure with a function to remove air from the bottle and the cap. The structures of the bottle and the bottle cap make it difficult for air to stay and make the air or bubbles flow out easily. By closing the bottle cap, the airtightness is increased. The bottle cap can prevent the bottle from being damaged and the seal (packing) from prematurely degrading when the cap is opened. Also, it can be closed with the same tightening torque no matter who closes it. Further, the bottle cap has a structure that prevents water from accumulating inside the cap. It also has a function to prevent damage to the bottle or container due to expansion and contraction of liquid. The contamination effects that affect analysis results can be reduced and the reliability of analysis results can be improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bottle cap, comprising:

a cap body comprising a cover plate and a cylinder part integral with said cover plate;

a stopper member protruding from an inner surface of said cover plate, wherein said stopper member comprises a sealing part supported by a support structure integral with said cover plate;

an annular guiding plate protruding from a sidewall surface of said cylinder part and inclined toward said stopper member to engage with said sealing part; and a central opening of said annular guiding plate communicating an inner space between said cover plate, said cylinder part, said stopper member and said annular guiding plate with an outside of the bottle cap.

2. The bottle cap according to claim 1, wherein said sealing part comprises a convex curved surface.

3. The bottle cap according to claim 1, wherein said annular guiding plate defines said central opening, and wherein an outer peripheral of said sealing part encloses said central opening in a plan view.

4. The bottle cap according to claim 1, wherein said sealing part further comprises a central bulge portion, a peripheral bulge portion surrounding said central bulge, and an annular recessed region between said central bulge portion and said peripheral bulge portion.

5. The bottle cap according to claim 4, wherein an upper rim of said annular guiding plate is located at said annular recessed region in a plan view.

6. The bottle cap according to claim 4, wherein said peripheral bulge portion is located while overlapping an upper portion of said annular guiding plate in a plan view.

7. The bottle cap according to claim 1, wherein said support structure comprises a vertical portion integral with said cover plate and a horizontal portion coupled to said vertical portion.

8. The bottle cap according to claim 7, wherein said vertical portion comprises a plurality of rods.

9. The bottle cap according to claim 8, wherein said support structure further comprises a prop secured to said inner surface of said cover plate and surrounded by said plurality of rods.

10. The bottle cap according to claim 9, wherein said horizontal portion is secured to a lower surface of said prop.

11. The bottle cap according to claim 10, wherein said sealing part is secured to said horizontal portion and is opposite to said prop.

12. The bottle cap according to claim 11, wherein said sealing part and said prop are composed of an elastic material.

13. The bottle cap according to claim 1, wherein said annular guiding plate comprises at least one perforation communicating said inner space with said outside of the bottle cap.

14. The bottle cap according to claim 13 further comprising an annular fixing structure integral with said cap body and in proximity to said cylinder part.

15. The bottle cap according to claim 14, wherein said inner space is divided into a first space and a second space by said annular fixing structure, and wherein said annular fixing structure comprises at least one channel that communicates said first space with said second space.

16. The bottle cap according to claim 1, wherein said cylinder part comprises a spiral female threaded portion situated under said annular guiding plate.

17. The bottle cap according to claim 1 further comprising an elastic sealing film adhered to a lower surface of said annular guiding plate.

18. A bottle comprising a bottle cap as claimed in claim 1.

19. The bottle according to claim 18, wherein said bottle comprises a bottle neck for said bottle cap to screw thereto.

20. The bottle according to claim 19, wherein said bottle neck comprises a spiral male threaded portion, and wherein said spiral male threaded portion is not continuous and comprises a slit in a vertical direction.

21. The bottle cap according to claim 1, wherein an upper rim of said annular guiding plate continuously encloses said central opening of said annular guiding plate.

22. The bottle cap according to claim 1, wherein said annular guiding plate is integrated with said cylinder part.

* * * * *